US006758358B1

(12) United States Patent
Bloom

(10) Patent No.: US 6,758,358 B1
(45) Date of Patent: Jul. 6, 2004

(54) CHILD-RESISTANT CONTAINER AND OVERCAP PACKAGE

(75) Inventor: Kenneth S. Bloom, Bloomdale, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/058,440

(22) Filed: Jan. 28, 2002

(51) Int. Cl.[7] ..... A61J 1/03; B65D 55/02

(52) U.S. Cl. ..... 215/206; 215/224; 215/321; 222/153.1

(58) Field of Search ..... 215/206, 224, 215/43, 46, 203, 317, 318, 321; 222/153.1; 220/788

(56) References Cited

U.S. PATENT DOCUMENTS

| | | | | | |
|---|---|---|---|---|---|
| 3,669,296 | A | | 6/1972 | Drew | |
| 4,335,823 | A | | 6/1982 | Montgomery | |
| 4,375,859 | A | * | 3/1983 | Fillmore | 215/223 |
| 4,775,062 | A | | 10/1988 | Carle | |
| 5,097,974 | A | * | 3/1992 | Rozenberg | 215/225 |
| 5,292,017 | A | * | 3/1994 | Reifers | 215/206 |
| 5,819,967 | A | * | 10/1998 | Lo | 215/206 |
| 5,938,054 | A | * | 8/1999 | Loader | 215/206 |
| 6,413,380 | B1 | * | 7/2002 | Pinarbasi | 204/192.11 |

* cited by examiner

*Primary Examiner*—Stephen K. Cronin
*Assistant Examiner*—Niki M. Eloshway

(57) ABSTRACT

A child-resistant package includes a container having a body with an open end for dispensing product. A shoulder on the body is positioned adjacent to the open end and has an external surface. A circumferential groove is recessed radially inwardly from the shoulder surface at an end of the shoulder remote from the container end. A bead around the shoulder extends radially outwardly from the shoulder surface and is spaced from the groove and the container end, and at least one external axially extending channel is parallel to the axis of the shoulder surface and extends into the surface from the groove through the shoulder and the bead. A cup-shaped overcap has an open end, at least one internal lug adjacent to the open end for receipt in the groove on the container shoulder, and a radially inwardly extending bead around an inner periphery of the cap spaced from the open end for snap-fit over the radially outwardly extending bead on the container shoulder. Indicia on the overcap and the container body facilitate axial alignment of the lug with the channel for removal of the overcap from the container. Snap-fit of the beads on the overcap and the shoulder stabilize the overcap on the container and reduce the mechanical advantage that would otherwise be obtained by grasping and bending the overcap with respect to the container body.

18 Claims, 3 Drawing Sheets

CHILD-RESISTANT CONTAINER AND OVERCAP PACKAGE

The present invention is directed to product dispensing packages that include elongated overcaps for covering dispensing structures such as finger pumps, and more particularly to provision of a child-resistant feature resisting removal of the overcap in packages of this type.

BACKGROUND AND SUMMARY OF THE INVENTION

In packages having an extended or elongated overcap, such as finger pump sprayer packages for topical application of liquids such as perfume, the extended dimension of the overcap can provide leverage for removal of the overcap. It is a general object of the present invention to provide a child-resistant package of this type, and a container and closure for such a package, and a method of assembling such a package, in which the mechanical advantage afforded by the extended dimension of the overcap is reduced, and in which resistance to removal of the overcap by a child is therefore enhanced.

A child-resistant package in accordance with one aspect of the present invention includes a container having a body with an open end for dispensing a product. A shoulder on the body is positioned adjacent to the open end and has an external radially outwardly facing surface. A circumferential groove is recessed radially inwardly from the shoulder surface at an end of the shoulder remote from the container end, a bead around the shoulder extends radially outwardly from the shoulder surface and is spaced between the groove and the container end, and at least one external axially extending channel is parallel to the axis of the shoulder surface and extends into the surface from the groove through the shoulder and the bead. A cup-shaped overcap has an open end, at least one internal lug adjacent to the open end for receipt in the groove on the container shoulder, and a radially inwardly extending bead around an inner periphery of the cap spaced from the open end for snap-fit over the radially outwardly extending bead on the container shoulder. Indicia on the overcap and the container body facilitate axial alignment of the lug with the channel for removal of the overcap from the container. Snap-fit of the beads on the overcap and the shoulder stabilize the overcap on the container and reduce the mechanical advantage that would otherwise be obtained by grasping and bending the overcap with respect to the container body.

A container for a child-resistant package in accordance with another aspect of the present invention includes a body with an open end for dispensing a product. A shoulder on the body is adjacent to the open end of the body and has an external cylindrical shoulder surface. A circumferential groove is recessed radially inwardly from the shoulder surface at an end of the shoulder remote from the container end. A bead around the shoulder extends radially outwardly from the shoulder surface and is spaced from the groove between the groove and the container end. At least one external axially extending channel is parallel to the axis of the shoulder surface and extends into the shoulder surface from the groove through the shoulder and the bead. An overcap for such a container, in accordance with a further aspect of the invention, is cup-shaped and has an open end. At least one internal lug is adjacent to the open end for receipt in the groove on the container shoulder, and a radially inwardly extending bead around the inner periphery of the overcap is spaced from the open end of the overcap for snap-fit over the radially outwardly extending bead on the container shoulder. Indicia on the overcap cooperates with corresponding indicia on the container body to facilitate axial alignment of the lug with the channel for removal of the overcap from the container.

A method of making a child-resistant package in accordance with yet another aspect of the present invention includes providing a container having a body with an end for dispensing product, a shoulder on the body adjacent to the end and having an external cylindrical shoulder surface, a circumferential groove that is recessed radially inwardly from the shoulder surface at an end of the shoulder remote from the container end, a bead around the shoulder extending radially outwardly from the shoulder surface and spaced from the groove and the container end, at least one external axially extending channel in the surface parallel to the axis of the shoulder surface, and indicia on the body aligned with the channel. A cup-shaped overcap has an open end, at least one internal lug adjacent to the open end for receipt in the groove, a radially inwardly extending bead around an inner periphery of the overcap spaced from the open end, and indicia on the external surface of the overcap aligned with the internal lug. The overcap is assembled to the container over the container shoulder such that the lug is received in the groove and the radially inwardly extending bead on the overcap is received by snap-fit over the radially outwardly extending bead on the shoulder.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
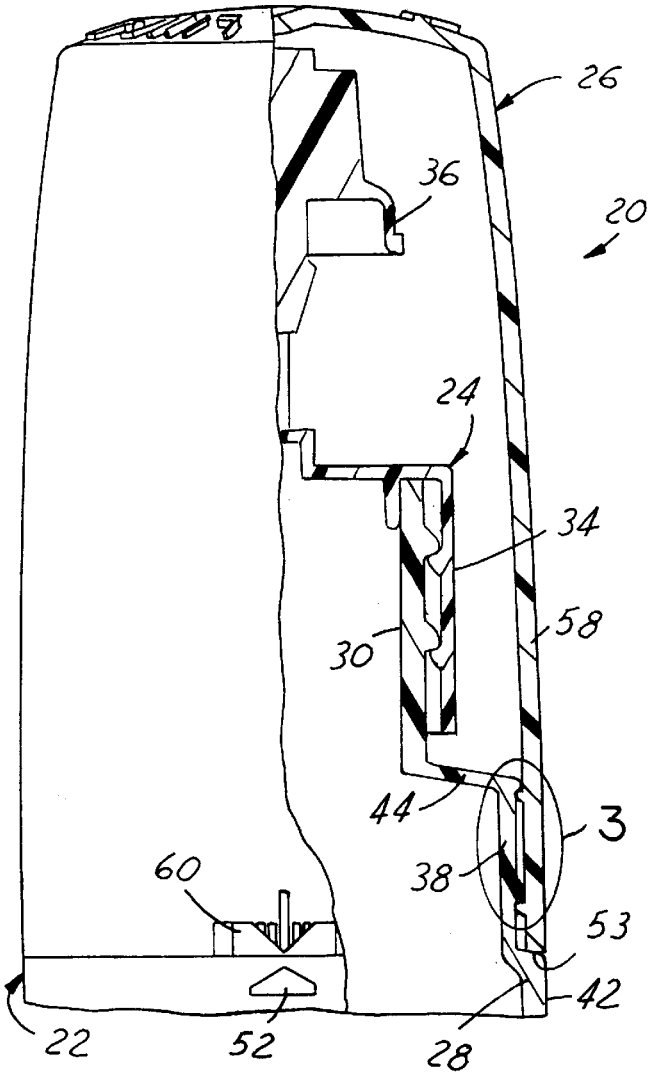
FIG. 1 is a fragmentary partially sectioned elevational view of a child-resistant package in accordance with one presently preferred embodiment of the invention.
Figure 2:
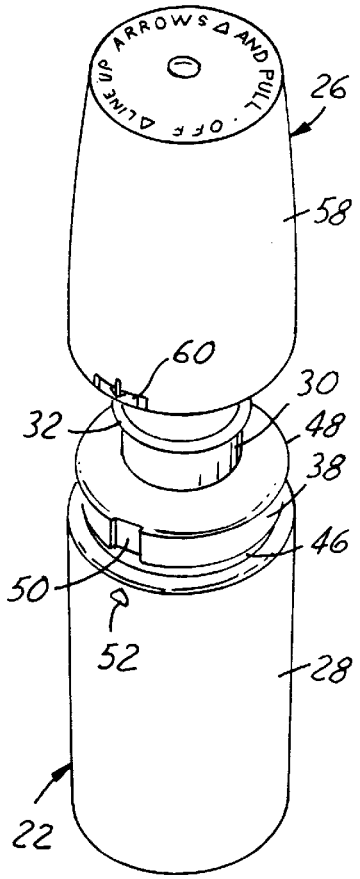
FIG. 2 is an exploded perspective view of the package illustrated in FIG. 1.
Figure 3:
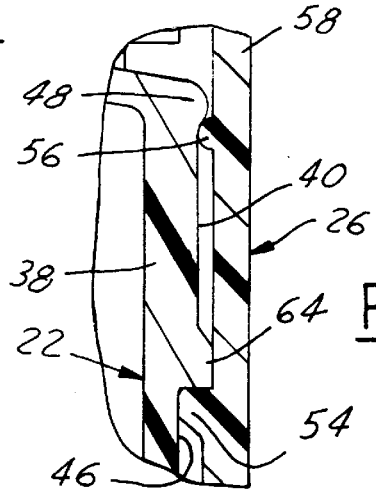
FIG. 3 is a fragmentary sectional view on an enlarged scale of the portion of FIG. 1 within the area 3.

FIGS. 1–3 illustrate a child-resistant package 20 in accordance with a presently preferred embodiment of the invention as comprising a container 22, a dispensing closure 24 secured to the container, and an overcap 26 secured to the container over the dispensing closure. Container 22 has a hollow body 28 for holding a liquid product to be dispensed. A cylindrical finish 30 extends from body 28 to define a container mouth, and has one or more external beads or threads 32 for securing closure 24 to the container. Closure 24 illustrated in the drawings is a finger-pump spray dispensing closure having a closure base 34 secured to container finish 30 and a pump actuator 36 extending from base 34. Closure 24 illustrated in the drawings is exemplary only.

Figure 4:
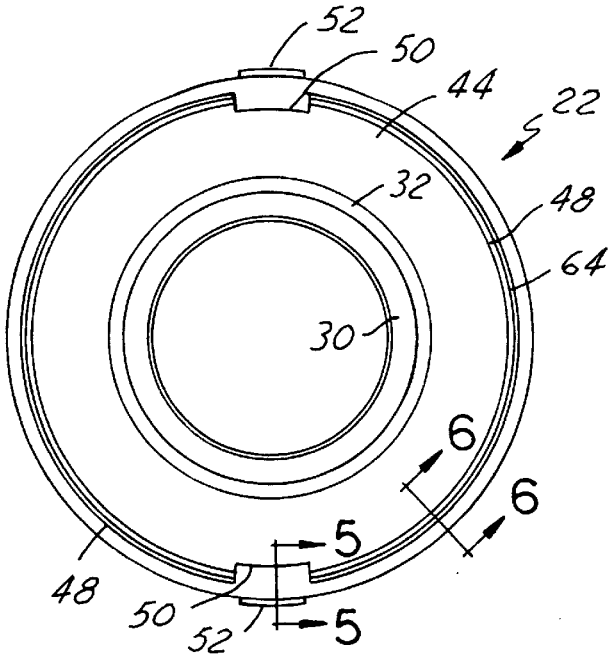
FIG. 4 is a top plan view of the container in the package of FIGS. 1–3.
Figure 5:
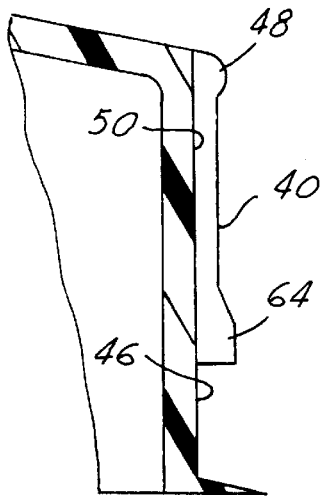
FIGS. 5 and 6 are fragmentary sectional views taken substantially along the lines 5—5 and 6—6 in FIG. 4.
Figure 6:
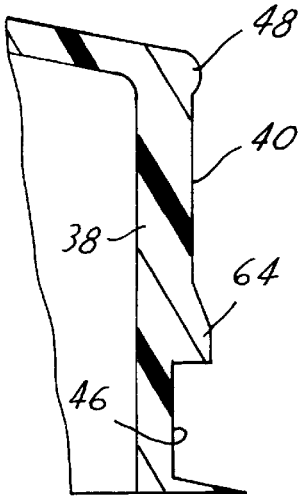
Figure 7:
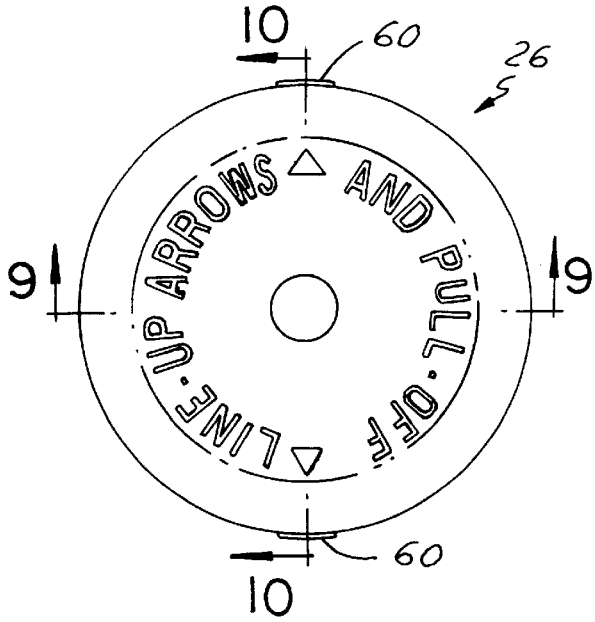
FIG. 7 is a top plan view of the overcap in the package of FIGS. 1–3.

Container 22 (FIGS. 1–6) includes a shoulder 38 adjacent to the outlet end defined by finish 30. Shoulder 38 has an external radially outwardly facing shoulder surface 40, preferably cylindrical, that is recessed radially inwardly from the external surface 42 of container body 28 (FIG. 1). Shoulder 38 also has an axially facing ledge 44 that extends to finish 30. Ledge 44 may be frustoconical as illustrated, flat or of any other suitable configuration. A circumferential groove 46 is recessed radially inwardly from shoulder surface 40 and extends entirely around shoulder 38 at an end of the shoulder remote from the open end of the container. A bead 48 around shoulder 38 extends radially outwardly from shoulder surface 40 at an end of shoulder 38 adjacent to the open end of the container. Thus, bead 48 is spaced axially from channel 46 by the length of shoulder 38. (Directional words such as "upwardly" and "downwardly" are employed by way of description and not limitation with respect to the upright orientation of the package illustrated in FIGS. 1–3. Directional words such as "axially" and "radially" are used by way of description and not limitation with respect to the central axis of container shoulder 38, which is preferably concentric with container finish 30 and body 28.) A pair of diametrically opposed channels 50 in shoulder 38 extend axially through the shoulder from groove 46 to ledge 44 and radially inwardly from outer surface 40 of shoulder 38. Channels 50 and groove 46 preferably have radially inner surfaces on a common cylinder of revolution coaxial with shoulder 38. Bead 48 is circumferentially segmented by channels 50, as best seen in FIG. 4. An external arrowhead 52 or other suitable alignment indicia is formed on outer surface 42 of container body 28 in axial alignment with respective channels 50. Container 22 may be blow molded of any suitable plastic material such as LDPE.

Figure 9:
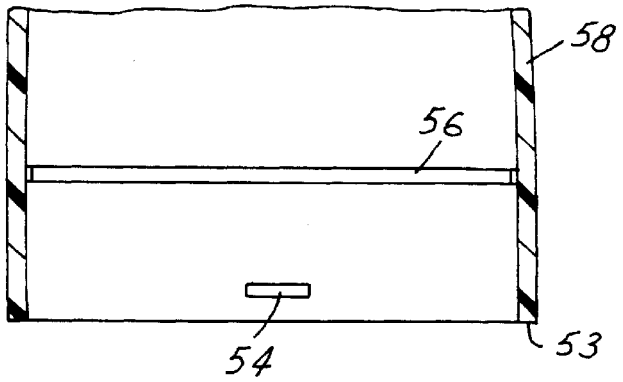
FIGS. 9 and 10 are fragmentary sectional views taken substantially along the lines 9—9 and 10—10 in FIG. 7.
Figure 8:
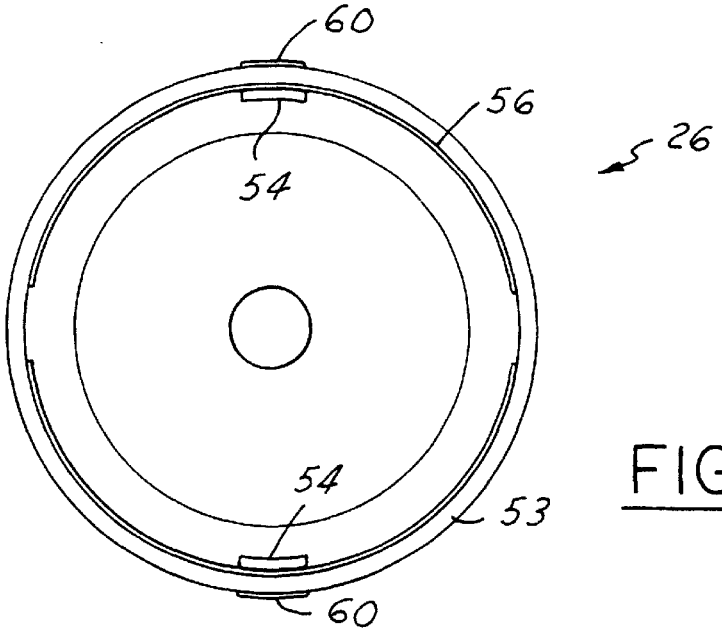
FIG. 8 is a bottom plan view of the overcap illustrated in FIG. 7.
Figure 10:
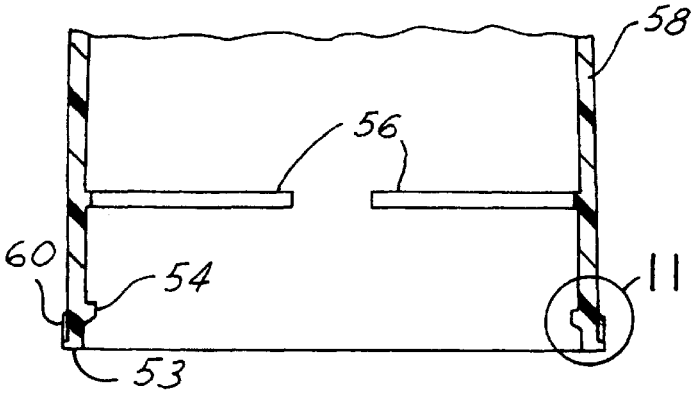
Figure 11:
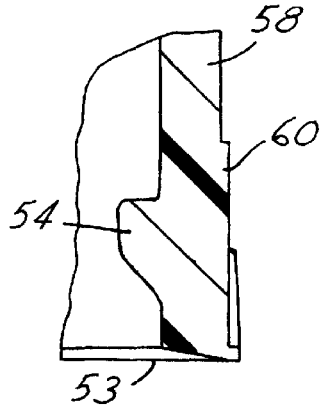
FIG. 11 is a fragmentary sectional view on an enlarged scale of the portion of the overcap within the circle 11 in FIG. 10.

Overcap 26 (FIGS. 1–3 and 7–11) is in the shape of an inverted cup having an open lower end 53. A pair of diametrically opposed internal lugs 54 are disposed adjacent to the open end of overcap 26 for receipt in container groove 46 when overcap 26 is assembled to container 22 (FIGS. 1 and 3). Lugs 54 are rectangular in side elevation (FIG. 9) and have a circumferentially arcuate dimension (FIG. 8) that is less than the arcuate dimension of channels 50 in container shoulder 38. A radially inwardly extending bead 56 is disposed around the inner periphery of overcap sidewall 58 adjacent to but spaced from open lower end 53 of the overcap sidewall. Bead 56 is preferably provided in arcuate bead segments, with a gap between bead segments at 90° spacing from lugs 54. This bead construction assists removal of overcap 26 from the forming mold. Bead 56 is spaced from open end 53 of overcap sidewall 58 by a distance such that bead 56 is received by snap-fit over bead 48 on container shoulder 38 (FIGS. 1 and 3) when the overcap is assembled to the container. A pair of arrowheads 60 or other suitable indicia are disposed at diametrically opposite positions on the outer surface of overcap sidewall 58 radially outwardly of lugs 54 and adjacent to open edge 53 of the overcap sidewall. Overcap 26 may be injection molded of any suitable plastic material such as polypropylene.

To disassemble overcap 26 from container 22, the overcap is rotated about the common axis of the overcap and the container shoulder until indicia 60 on overcap 26 axially aligns with indicia 52 on container sidewall 28. At this point, internal lugs 54 on overcap sidewall 58 are aligned with external channels 50 on container shoulder 38. The overcap may then be axially removed from the container by snapping overcap bead 56 over container shoulder bead 48. The overcap may be reassembled to the container in reverse fashion, although it is not necessary to align indicia 52, 60 during reassembly. With the overcap assembled to the container and indicia 52. 60 non-aligned, it is difficult to remove the overcap from the container. In particular, overcap bead 56 cooperates with container shoulder bead 48 to stabilize the overcap on the container and reduce the mechanical advantage that would otherwise result from the elongated dimension of the overcap. Ribs may be provided on the internal surface of overcap sidewall 58 for abutment with shoulder ledge 44 further to stabilize the overcap on the container. A bead 64 (FIGS. 3, 5 and 6) may be provided around container shoulder 38 adjacent to groove 46 to enhance resistance to removal of the overcap when indicia 52, 60 are non-aligned. Bead 64 is, of course, segmented by channels 50 on shoulder 38.

There has thus been disclosed a child-resistant package, a container and an overcap for use in such a package, and a method of making such a package, which fully satisfy all of the objects and aims previously set forth. The invention has been described in connection with a presently preferred embodiment thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A child-resistant package that includes:

a container having a body with an end for dispensing product, a shoulder on said body adjacent to said end and having an external radially outwardly facing shoulder surface, a circumferential groove that is recessed radially inwardly from said shoulder surface at an end of said shoulder remote from said container end, a bead around said shoulder extending radially outwardly from said shoulder surface and spaced from said groove between said groove and said container end, and at least one external axially extending channel parallel to the axis of said shoulder surface extending into said surface from said groove through said shoulder and said bead, a cup-shaped overcap having an open end, at least one internal lug adjacent to said open end for receipt in said groove, and a radially inwardly extending bead around an inner periphery of said overcap spaced from said open end for snap-fit over said radially outwardly extending bead on said shoulder, and indicia on said overcap and said container body to facilitate axial alignment of said at least one lug with said at least one channel for removal of said overcap from said container, snap fit of said beads on said overcap and said shoulder stabilizing said overcap on said container.

2. The package set forth in claim 1 wherein said radially outwardly facing shoulder surface is cylindrical.

3. The package set forth in claim 2 wherein said container body has an external sidewall surface, and said external cylindrical shoulder surface is recessed radially inwardly from said external sidewall surface.

4. The package set forth in claim 2 wherein said circumferential groove and said channel have radially facing surfaces on a common cylinder of revolution around said axis.

5. The package set forth in claim 1 wherein said shoulder has diametrically opposed external channels, and said overcap has diametrically opposed internal lugs.

6. The package set forth in claim 1 wherein said bead on said overcap is circumferentially discontinuous.

7. The package set forth in claim 6 wherein said bead on said overcap has diametrically opposed gaps spaced 90° from said at least one lug.

8. The package set forth in claim 1 wherein said container further includes a finish extending from said shoulder to said end and a dispensing closure secured to said finish.

9. A container for a child-resistant package that includes a body with an end for dispensing product, a shoulder on said body adjacent to said end and having an external cylindrical shoulder surface, a circumferential groove that is recessed radially inwardly from said shoulder surface at an end of said shoulder remote from said container end, a bead around said shoulder extending radially outwardly from said shoulder surface and spaced from said groove between said groove and said container end, and at least one external axially extending channel parallel to the axis of said shoulder surface extending into said surface from said groove through said shoulder and said bead.

10. The container set forth in claim 9 wherein said shoulder has diametrically opposed external channels.

11. The container set forth in claim 9 wherein said container body has an external sidewall surface, and said external cylindrical shoulder is recessed radially inwardly from said external sidewall surface.

12. The container set forth in claim 9 wherein said container further includes a finish extending from said shoulder to said end and a dispensing closure secured to said finish.

13. The container set forth in claim 9 wherein said circumferential groove and said channel have radially facing surfaces on a common cylinder of revolution around said axis.

14. An overcap for a child-resistant package that includes a container having a body with an end for dispensing product, an external shoulder on said body adjacent to said end, a circumferential groove that is recessed radially inwardly from said shoulder at an end of said shoulder remote from said container end, a radially outwardly extending bead around said shoulder and spaced from said groove between said groove and said container end, at least one external channel parallel to the axis of said shoulder extending from said groove through said shoulder and said bead, and indicia on said body aligned with said channel, said overcap being cup-shaped and having an open end, at least one internal lug adjacent to said open end for receipt in the container groove, a radially inwardly extending bead around an inner periphery of said overcap spaced from said open end for snap-fit over the radially outwardly extending bead on the container shoulder, and indicia on said overcap to facilitate axial alignment of said at least one lug with said at least one channel for removal of said overcap from the container.

15. The overcap set forth in claim 14 for use with a container having a shoulder has diametrically opposed external channels, wherein said overcap has diametrically opposed internal lugs.

16. The overcap set forth in claim 14 wherein said bead on said overcap is circumferentially discontinuous.

17. The overcap set forth in claim 16 wherein said bead on said overcap has diametrically opposed gaps spaced 90° from said at least one lug.

18. A method of making a child-resistant package that includes:

(a) providing a container having a body with an end for dispensing product, a shoulder on said body adjacent to said end and having an external cylindrical shoulder surface, a circumferential groove that is recessed radially inwardly from said shoulder surface at an end of said shoulder remote from said container end, a bead around said shoulder extending radially outwardly from said shoulder surface and spaced from said groove and said container end, at least one external axially extending channel in said surface parallel to the axis of said shoulder surface, and indicia on said body aligned with said channel, (b) providing a cup-shaped overcap having an open end, at least one internal lug adjacent to said open end for receipt in said groove, a radially inwardly extending bead around an inner periphery of said overcap spaced from said open end, and indicia on an external surface of said overcap aligned with said lug, and (c) assembling said overcap to said container over said shoulder such that said lug is received in said channel and said radially inwardly extending bead on said overcap is received by snap fit over said radially outwardly extending bead on said shoulder.

* * * * *